US005279640A

United States Patent [19]

Ogura et al.

[11] Patent Number: 5,279,640

[45] Date of Patent: Jan. 18, 1994

[54] METHOD OF MAKING IRON-BASED POWDER MIXTURE

[75] Inventors: Kuniaki Ogura; Shigeaki Takajo; Hiroyuki Ishikawa; Akio Sonobe; Yoshiaki Maeda; Toshiyuki Minegishi, all of Chiba, Japan

[73] Assignee: Kawasaki Steel Corporation, Japan

[21] Appl. No.: 948,668

[22] Filed: Sep. 22, 1992

[51] Int. Cl.[5] ..... B22F 9/04

[52] U.S. Cl. ..... 75/343; 75/770

[58] Field of Search ..... 75/343, 370, 770

[56] References Cited

U.S. PATENT DOCUMENTS 4,946,499 8/1990 Sakuranda et al. ..... 75/343

5,154,881 10/1992 Rutz et al. ..... 419/37

*Primary Examiner*—George Wyszomierski

*Attorney, Agent, or Firm*—Austin R. Miller

[57] ABSTRACT

An iron-based powder mixture for powder metallurgy essentially consists of a melted mixture, as a binder, which includes about 0.1% to about 1.0% by weight of a powder of at least one organic compound selected from stearic acid, oleic acid amide, and stearic acid amide, and about 0.1% to about 1.0% by weight of a powder of stearic acid bisamide; and the balance which is an iron-based powder, to the surface of which adhered about 0.1% to about 3.0% by weight of an alloying powder and/or a powder for improving machinability. Disclosed also is a method of producing the mixture.

4 Claims, No Drawings

METHOD OF MAKING IRON-BASED POWDER MIXTURE

BACKGROUND OF THE INVENTION

1. Field of the Invention

The present invention relates to a method of modifying powder materials used for manufacture of machine parts by powder metallurgy, and more particularly relates to an iron-based powder mixture for powder metallurgy and a manufacturing method thereof, producing an improved powder mixture having stabilized apparent density, less segregation of additives, and superior fluidity characteristics when discharged from a hopper; which method requires less force when ejected from a die in a compacting process; and which material contains no zinc or small amounts of zinc at most.

2. Description of the Related Art

Conventional powder materials used for machine parts have been mixed powders in which the alloying powder of the components for the improvement of solid-state properties, such as copper, nickel, graphite, and phosphorus, was mixed into an iron powder. A lubricant such as zinc stearate was also mixed into the powder to reduce abrasion resistance during compressed molding. However, these powder mixtures tended to experience powder segregation, which readily occurred during transport after mixing, loading and unloading to and from a hopper, or during molding, because the powder mixture contained powders of different sizes, shapes, and densities.

This segregation caused fluctuations in product composition, which increased fluctuation of dimensional changes and strength, and thus produced defective products. Furthermore, graphite and the like, due to their properties as impalpable powders, enlarge the specific surface area of the powder mixture, thus impairing fluidity. This impairment lowers the injection speed to the die, which also reduces the production speed of the green compact. Technology for preventing segregation of these powder mixtures is disclosed in Japanese Patent Laid-Open No.56-136901 or No. 58-28231, in which a binder is used for preventing segregation. However, the more the amount of binder that is to improve segregation of the powder mixture, the lower the fluidity of the powder mixture.

A powder in which graphite was adhered to the surface of the iron-based powder with a binder of zinc stearate was disclosed in the Japanese Patent Laid-Open No. 1-219101. Also, we have proposed a method employing a metal soap and a fatty acid as a binder in Japanese Patent Laid-Open No. 3-162502. However, all of the above mentioned methods included zinc and other metallic elements in the binders, which caused a major problem since metallic elements in the binders, as oxides, contaminated the inside of the furnace, or varied the composition of the sintered body during sintering.

To overcome these problems, some methods employ binders having no metallic elements, as disclosed in Japanese Patent Publication No. 60-502158 and Japanese Patent Laid-Open No. 2-217403, wherein the binders themselves do not have a lubricating function, and thus zinc stearate was added as the lubricant in the end. Therefore, as described before, zinc in the lubricant contaminated the inside of the furnace as an oxide or varied the composition of the sintered body.

SUMMARY OF THE INVENTION

Accordingly, an object of the present invention is to provide an iron-based powder mixture for powder metallurgy, and to provide a manufacturing method thereof, wherein the powder mixture has a stabilized apparent density, less segregation, superior characteristics of fluid flow from a hopper, and no zinc or a small amount at most, while maintaining the powder characteristics and the green compact characteristics of the mixture.

Notwithstanding the above problems, we have created a successful iron-based powder mixture for powder metallurgy which has overcome conventional drawbacks, and which can be produced inexpensively in large quantities. In particular, the mixture may be produced by adhering the alloying powder and the powder for improving machinability to the surface of the iron-based powder as a binder which is made of a melted powder mixture of at least one powder of an organic compound selected from a low melting point group having a melting point of about 69°-103° C. and consisting of stearic acid, oleic acid, and stearic acid amide, and a high melting point component comprising stearic acid bisamide organic compound powder having a high melting point of about 147° C., and mixing the free powders of a lubricant into the powder mixture at a temperature below the melting point.

Accordingly, an object of the present invention is to provide such an advantageous mixture and a manufacturing method for its efficient production.

The present invention provides a method for producing an iron-based powder mixture for powder metallurgy, comprising the steps of:

mixing about 0.1% to about 1.0% by weight of a powder of at least one organic compound selected from a first (low-melting) group comprising stearic acid, oleic acid amide, and stearic acid amide, about 0.1% to about 1.0% by weight of a powder of an organic compound of a second (high-melting) amide comprising stearic acid bisamide, about 0.1% to about 3.0% by weight of an alloying powder and/or a powder for improving machinability, and the balance an iron-based powder;

heating the resulting powder mixture thereafter for about 30 seconds to about 30 minutes at a temperature ranging from about ten degrees C above the lowest melting point of an organic compound of the low-melting group to a temperature not exceeding the melting point of the highermelting bisamide organic compound; and subsequently cooling the mixture.

The invention further relates to a method for producing an iron-based powder mixture for powder metallurgy, comprising the steps of:

mixing about 0.1% to about 0.5% by weight of at least one lubricant-free powder selected from the group consisting of stearic acid, oleic acid amide, stearic acid amide, stearic acid bisamide, and a heated mixture of stearic acid amide and stearic acid bisamide, and mixing this lubricant-free powder with the iron-based powder mixture, and mixing and heating the resulting powder mixture for about 30 seconds to about 30 minutes at a temperature below the melting temperature of any component.

The present invention is further directed to an iron-based powder mixture for powder metallurgy, comprising:

a melted mixture, as a binder, which comprises about 0.1% to about 1.0% by weight of a powder of at least one organic compound selected from a first (low-melting) group consisting of stearic acid, oleic acid amide, and stearic acid amide, and about 0.1% to about 1.0% by weight of a powder of a (high-melting) organic compound comprising stearic acid bisamide; and the balance of which is an iron-based powder, to the surface of which is adhered about 0.1% to about 3.0% by weight of an alloying powder and/or a powder for improving machinability.

The invention further relates to an iron-based powder mixture for powder metallurgy comprising a lubricant containing about 0.1% to about 0.5% by weight of at least one free lubricant powder selected from the group consisting of stearic acid, oleic acid amide, stearic acid amide, stearic acid bisamide, and a heated mixture of stearic acid amide and stearic acid bisamide, and/or wherein about 0.01% to about 0.25% by weight of a free powder of zinc stearate are mixed without causing adhesion by melting to the surface of the iron-based powder.

The expression "free powder" as used herein indicates a powder which is not adhered by melting to the iron-based powder surface, but is simply physically blended in the mixture.

The expression "heated mixture" as used herein indicates a powder which can be obtained by heating, melting, mixing, cooling and then crushing a powder of not less than two organic compounds.

According to the present invention, particle segregation can be prevented by the adhesion, by means of the binder, of the alloying powder and/or the powder for improving machinability to the surface of the iron-based powder.

In consideration of the characteristics required of the product, the following materials are used in the required amounts:

A pure iron powder and/or alloyed iron powder, processed by methods such as pulverization or atomization, may be used as the iron-based powder; a graphite powder or an alloying powder may be used as the powder for an alloy; and talc or metallic sulfide may be used as the powder for improving machinability of the sintered body.

Not only the alloying powder and/or the powder for improving machinability and the stearic acid bisamide can be adhered to the surface of the iron-based powder, but also the fluidity of the iron-based powder can be improved by using, as a binder, at least one melted compound of the first group in which the stearic acid (melting point 69° C.), oleic acid amide (melting point 76° C.), and stearic acid amide (melting point 103° C.) having a low melting point are included. Furthermore, by partially melting the powder of stearic acid bisamide (melting point 147° C.) of a high melting point and combining it with the low-melting powder of the organic compound of the first group as the binder, and heating to melt the one but not the other, the fluidity of the iron-based powder mixture can be improved and the force required for ejection of the product from the die can be significantly reduced.

Further, by combining the fatty acid such as stearic acid and the fatty acid amide such as stearic acid bisamide, the fluidity of the mixture can be improved and the alloying powder and/or the powder for improving machinability can be adhered to the surface of the iron-based powder, with the beneficial result that the force required for ejection of the iron-based powder from the die can be significantly reduced.

Referring to the fatty acids of the first or low-melting group, the amount of powder of the organic compound, the heated and melted mixture as a binder, ranges between about 0.1 and 1.0% by weight. When the amount of the powder is less than about 0.1% by weight, a ratio of the amount of graphite contained in the total mixture, which was heated and mixed, to the amount of graphite contained in the powder from about 100 to 200 mesh in the mixture (hereinafter defined as the degree of graphite adhesion) is reduced below about 50%; also the force required for ejecting the product from a die after compacting decreases significantly. When the amount of powder is more than about 1.0% by weight, the fluidity of the mixture in flowing from the supply hopper deteriorates.

One reason for substantially excluding zinc from the binder is to prevent contamination on the surface of the sintered body during sintering.

In addition, from about 0.1 to 3.0% by weight of an alloying powder and/or a powder for improving machinability may be added. In this case, when the amount of the powder added is less than about 0.1% by weight, no significant advantage is realized because of the small amount applied. On the other hand, when the amount of the added powder exceeds about 3.0% by weight, the degree of adhesion of the alloying powder and the powder for improving machinability is reduced to about 50% or less, which reduces the efficiency of the mixture.

The iron-based powder mixture of the present invention can be obtained by mixing and then heating the iron-based powder, the alloying powder and/or the powder for improving machinability together with the aforementioned specific organic compounds of the first (low-melting) and second (high-melting) groups. The preferable heating temperature ranges from about 10° C. above the melting point of the selected lower-melting component or the one having the lower melting point when there is more than one component of the first group which has a low melting point (the group comprises stearic acid, oleic acid amide or stearic acid amide which melt at about 69°, 76° and 103° C., respectively) to the melting point of the stearic acid bisamide which has a relatively high melting point of about 147° C.. In other words, as an example, when stearic acid (69° C.) is selected to be heated with the stearic acid bisamide, the minimum heating temperature should be about 69+10=79° C. up to the 147° C. melting point of the stearic acid bisamide. When the heating temperature is less than the above, the adhesion of the alloying powder and/or the powder for improving machinability to the surface of the iron-based powder is insufficient. On the other hand, when the heating temperature is higher than the melting point of the stearic acid bisamide, the fluidity of the iron-based powder deteriorates and the compounds having the lower melting point degenerate, which increases the cost of the processing facilities and their operation. Because the heating temperature is higher than the melting points of the lower-melting compounds of the first group, the powders of the compounds of the first (low-melting) group are substantially completely melted. Thus these melted compounds cause adhesion, as a binder, of the alloying powder and/or the powder for improving machinability to the surface of the iron-based powder. On the other hand, since the heating temperature is lower than the melting point of the higher-melting stearic acid bisamide it melts only partially if at all and adheres well to the surface of the iron-based powder.

By maintaining these heating and processing conditions, the fluidity of the iron-based powder is enhanced and the sintered body may easily be ejected from the die after compacting.

The required heating and mixing time ranges from about 30 seconds to about 30 minutes. A heating and mixing time of less than about 30 seconds causes non-uniform adhesion of the alloying powder and/or the powder for improving machinability to the surface of the iron-based powder. On the other hand, a heating and mixing time of more than about 30 minutes causes peeling of the adhered powders. Further, the preferable heating and mixing time ranges from about 5 to 20 minutes.

The organic compounds of both groups are, of course, non-metallic; therefore, a compacted body made of the iron-based powder mixture of the present invention does not contaminate the inside of the furnace by generation of dust containing metallic element and/or contaminate the surface of the sintered body by the metallic elements. The kind and amounts of the organic compounds to be used are based upon the kind, shape, and particle-size construction of the iron-based powder and the kind, shape, and added amount of the alloying powder and/or the powder that is added for improving machinability.

The iron-based powder mixture according to the present invention can achieve better ejecting force from the die and/or fluidity by adding a lubricant. The added lubricant may comprise a room temperature free powder selected from the group consisting of stearic acid, oleic acid, stearic acid amide, stearic bisamide, and a heated mixture of stearic acid amide and stearic acid bisamide; or a small amount of the free powder of zinc stearate; or a free powder of any of these organic compounds and a small amount of zinc stearate.

In the present invention the organic compounds which separately comprise the heated and melted mixture previously described, and the room temperature powder mixture, are then mixed. The degree of adhesion of the alloying powder and/or the powder for improving machinability is improved by the heated and melted mixture; the ejecting force from the die i reduced by lubricating action of the room temperature powder mixture.

The amount of the lubricant powder added to the mixture should not be less than about 0.1% by weight and not more than about 0.5% by weight. When the added amount is less than about 0.1% by weight, the die ejecting force does not improve markedly after compacting. On the other hand, when the added amount of lubricant is more than about 0.5% by weight, the fluidity from the hopper of the mixture decreases.

The added amount of zinc stearate lubricant should preferably not be less than about 0.01% by weight nor more than about 0.25% by weight. When the added amount is less than about 0.01% by weight, fluidity of the mixture when fed from the hopper cannot be improved. On the other hand, when the added amount is more than about 0.25% by weight contamination occurs on the surface of the sintered body.

The required time for adding these free powders to the iron-based powder and mixing ranges between about 30 seconds and about 30 minutes at room temperature. Less than about 30 seconds results in incomplete mixing, and more than about 30 minutes causes deformation of the particles of the free powders which diminishes the effect of reducing the ejecting force exerted on the compacted body from the die. Accordingly, the preferable adding and mixing time ranges from about 5 to 20 minutes.

DETAILED DESCRIPTION OF THE PRESENT INVENTION

A detailed description of the present invention will now be given in conjunction with the accompanying tables.

PRACTICAL EXAMPLE 1

Stearic acid or oleic acid amide or stearic acid amide of the first group, and stearic acid bisamide of the second group, as a binder, were added in amounts shown in Table 1, into an atomizing iron powder for powder metallurgy. The powder had an average particle diameter of 78 μm.

Then 0.8% by weight of a graphite powder having an average particle diameter of 16 μm, was also added as an alloying powder, into the atomized iron powder. The powder was mixed with heating and (partial) melting for 20 minutes at 120° C. and then cooled.

Then 1.5% by weight of a copper powder was added as the alloying powder into sample No. 8, and talc having main components of MgO and $SiO_2$ with an average particle diameter of not more than 44 μm were added as a powder for improving machinability into sample No. 9.

Reduced iron powder, instead of atomized iron powder, with an average particle diameter of 78μm was used in Sample No. 10.

In the comparative example the atomized iron powder was the same powder used in the practical example 1 of the present invention. Each organic chemical powder of the first and second groups was the only powder added as a binder.

Furthermore, zinc stearate used for a conventional lubricant was employed by mixing at a room temperature without heating as sample No. 5 of a comparative example.

The results of practical example 1 are shown in Table 1. The ejecting force shown in Table 1 indicates the ejecting force needed for ejecting a 25 mm-diameter and 20 mm-height tablet from a die, wherein the tablet was made of the powder provided in both the practical example and the comparative example, and compacted at 5 t/cm$^2$ of the compacting pressure.

The degree of graphite (C) adhesion in the powder is represented by the ratio of the amount of C in the powder of particle size ranging from 100 to 200 mesh of this mixture to the amount of C of the total mixture which was heated, melted, and mixed.

The degree of carbon adhesion is indicated as the ratio of (C analysis value in 100–200 mesh)/(C analysis value in the total mixture)×100(%).

Under the above conditions, the degree of talc adhesion was measured by the same method as the one used for the carbon.

The fluidity characteristics of the powder are represented by the fluidity time of a 100 g mixture from a 5.1 mm diameter orifice provided at the bottom center of a container which is 40 mm in diameter and 100 mm high, to which a 100 g mixture of powder mixture at room temperature was added.

In the present invention in which the above described specific organic compound was melted, the powder mixture for the powder metallurgy, in comparison with the conventional comparative example, had a high degree of graphite adhesion, and achieved less segregation and less ejecting force and superior fluidity.

In addition, samples No. 1 to No. 3 of the comparison example, to which only the lower melting point organic compound was added, had deteriorated fluidity.

Likewise, sample No. 4 of the comparison example, to which only the high melting point organic compound was added, had reduced ejecting force but deteriorated degree of graphite adhesion. Sample No. 5 of comparative example, to which zinc stearate powder was added by conventional room temperature mixing has the deteriorated ejecting force and degree of graphite adhesion.

cal copper powder of practical example 1 was used as the alloying powder in sample No. 8, and the identical talc of practical example 1 was used as the powder for improving machinability. The same heating temperatures and times as those in practical example 1 were applied.

The lubricants were mixed into the above obtained iron-based powder mixture for 10 minutes at room temperature.

Added free powders as the above mentioned lubricants were stearic acid, oleic acid, stearic acid amide, stearic acid bisamide, and a heated mixture of stearic acid amide and stearic acid bisamide.

In the related comparison example, the same atomized iron powder as the one used in the practical example was used, and powders of organic compounds in the first and second groups were the only powders added as a binder. The degree of C adhesion, fluidity, and ejecting force of the obtained mixture were measured in the same manner as in practical example 1. The result of the measurement is shown in Table 2. All the practical examples showed 85% or more of the degrees of C and Talc adhesions, preferable fluidity, and low ejecting force. On the contrary, in the comparison example, fluidity deteriorated.

TABLE 1

| | | Heating and Melting Mixture (wt %) | | | | | | | Rt. Powder Mixtr. (wt %) | | | | |
|---|---|---|---|---|---|---|---|---|---|---|---|---|---|
| | | Alloy Powder | | | 1st Group | | | 2nd Group | | | | | |
| | No. | Cu | Graphite | *P.I.M. | St. Acid. | Ol. Acid Amd | St. Acid Amd | St. Acid BsAmd | Zn Stearate | C Adhesion (%) | Talc Adhesion (%) | Fluidity (sec/100 g) | Ejecting Force (kgf/cm²) |
| Ex. | 1 | | 0.8 | | | | 0.2 | 0.2 | | 85 | | 13.1 | 125 |
| | 2 | | 0.8 | | 0.2 | | | 0.2 | | 89 | | 13.3 | 105 |
| | 3 | | 0.8 | | | 0.2 | | 0.2 | | 89 | | 13.1 | 109 |
| | 4 | | 0.8 | | 0.15 | | 0.15 | 0.1 | | 85 | | 13.0 | 115 |
| | 5 | | 0.8 | | 0.15 | 0.15 | | 0.1 | | 87 | | 13.1 | 111 |
| | 6 | | 0.8 | | | 0.15 | 0.15 | 0.1 | | 88 | | 13.1 | 111 |
| | 7 | | 0.8 | | 0.15 | 0.15 | 0.15 | 0.1 | | 89 | | 13.3 | 114 |
| | 8 | 1.5 | 0.8 | | | | 0.2 | 0.2 | | 86 | | 13.0 | 123 |
| | 9 | | 0.8 | 1.2 | | | 0.2 | 0.2 | | 87 | 88 | 13.1 | 126 |
| | 10 | | 0.8 | | | | 0.2 | 0.2 | | 87 | | 13.0 | 101 |
| Comp. | 1 | | 0.8 | | 0.4 | | | | | 88 | | 15.6 | 120 |
| Ex. | 2 | | 0.8 | | | | 0.4 | | | 87 | | 15.7 | 126 |
| | 3 | | 0.8 | | | 0.4 | | | | 87 | | 15.6 | 123 |
| | 4 | | 0.8 | | | | | 0.4 | | 59 | | 13.3 | 143 |
| | 5 | | 0.8 | | | | | | 0.4 | 24 | | 13.5 | 130 |

*Powder for Improving Machinability

PRACTICAL EXAMPLE 2

The identical iron powder, binder, and alloy powders of practical example 1 were used. The added amounts are shown in Table 2. In practical example 2, the identi-

TABLE 2

| | | Heating and Melting mixture (wt %) | | | | | | | Rt. Powder Mixtr. (wt %) | | | | | |
|---|---|---|---|---|---|---|---|---|---|---|---|---|---|---|
| | | Alloy Powder | | | 1st Group | | | 2nd Group | | | | | | |
| | No. | Cu | Graphite | *P.I.M. | St. Acid. | Ol. Acid Amd | St. Acid Amd | St. Acid BsAmid | Lubricant | Addtv. Amt. | C Adhesion (%) | Talc Adhesion (%) | Fluidity (sec/100 g) | Ejecting Force (kgf/cm²) |
| Ex. | 1 | | 0.8 | | | | 0.2 | 0.2 | St. Acid | 0.4 | 85 | | 13.2 | 96 |
| | 2 | | 0.8 | | 0.15 | | 0.15 | 0.1 | | 0.5 | 85 | | 13.1 | 94 |
| | 3 | | 0.8 | | 0.2 | | | 0.2 | Ol. Acid | 0.3 | 89 | | 13.4 | 97 |
| | 4 | | 0.8 | | | 0.15 | 0.15 | 0.1 | Amd | 0.4 | 88 | | 13.3 | 92 |
| | 5 | | 0.8 | | | 0.2 | | 0.2 | St. Acid | 0.4 | 89 | | 13.3 | 97 |
| | 6 | | 0.8 | | 0.15 | 0.15 | | 0.1 | Amd | 0.2 | 87 | | 13.2 | 98 |
| | 7 | | 0.8 | | 0.2 | | | 0.2 | St. Acid | 0.3 | 89 | | 13.3 | 101 |
| | 8 | 1.5 | 0.8 | | | 0.2 | | 0.2 | BsAmd | 0.4 | 89 | | 13.2 | 99 |
| | 9 | | 0.8 | 1.2 | | | 0.2 | 0.2 | | 0.4 | 85 | 86 | 13.0 | 95 |
| | 10 | | 0.8 | | 0.15 | 0.15 | | 0.1 | | 0.2 | 87 | | 13.2 | 102 |
| | 11 | | 0.8 | | | 0.15 | 0.15 | 0.1 | | 0.5 | 88 | | 13.1 | 94 |
| | 12 | | 0.8 | | 0.15 | | 0.15 | 0.1 | St. Acid | 0.4 | 85 | | 13.0 | 93 |
| | 13 | | 0.8 | | 0.15 | 0.15 | 0.15 | 0.1 | BsAmd | 0.5 | 89 | | 13.4 | 96 |
| | 14 | | 0.8 | | | | 0.2 | 0.2 | **Mixtr. | 0.4 | 85 | | 13.0 | 93 |
| | 15 | | 0.8 | | 0.15 | 0.15 | 0.15 | 0.1 | | 0.5 | 89 | | 13.2 | 94 |
| Comp. | 1 | | 0.8 | | 0.2 | | | 0.2 | St. Acid | 0.6 | 89 | | 14.7 | 93 |

TABLE 2-continued

| | | Heating and Melting mixture (wt %) | | | | | | | | Rt. Powder Mixtr. (wt %) | | C Adhesion (%) | Talc Adhesion (%) | Fluidity (sec/100 g) | Ejecting Force (kgf/cm²) |
|---|---|---|---|---|---|---|---|---|---|---|---|---|---|---|---|
| | | Alloy Powder | | | 1st Group | | | 2nd Group | | | | | | | |
| | No. | Cu | Graphite | *P.I.M. | St. Acid. | Ol. Acid Amd | St. Acid Amd | St. Acid BsAmid | | Lubricant | Addtv. Amt. | | | | |
| Ex. | 2 | | 0.8 | | | | 0.4 | | | Ol. Acid Amd | 0.6 | 87 | | 16.0 | 115 |
| | 3 | | 0.8 | | | 0.4 | | | | St. Acid Amd | 0.6 | 87 | | 15.8 | 118 |
| | 4 | | 0.8 | | 0.4 | | | | | St. Acid BsAmd | 0.6 | 88 | | 15.8 | 109 |
| | 5 | | 0.8 | | | 0.4 | | | | **Mixtr. | 0.6 | 87 | | 15.8 | 108 |

*Powder for Improving Machinability
**Heated Mixture of Stearic Acid & Stearic Acid Bisamide

PRACTICAL EXAMPLE 3

The identical iron powder, binder, and alloying powder as in practical example 1 were used, and the added amount of each of these is shown in the Table 3. In the sample No. 3, the identical copper powder of practical example 1 was used as the alloying powder. In sample 5, the identical talc of practical example 1 was used as the alloying powder. The iron powder, binder, and alloying powder were mixed with heating and melting for 10 minutes at 115° C., then cooled and mixed with zinc stearate as a lubricant for 10 minutes at room temperature. In the comparative example, the identical atomized iron powder of the practical example were used, and zinc stearate in an amount exceeding the appropriate range was added as a lubricant. Then, the degree of C adhesion, fluidity, and ejecting force of the obtained mixture were measured in the same manner as that of practical example 1. The result of the measurements is shown in Table 3.

In the practical example 3 of the present invention, advantageous characteristics of the degree of adhesion, fluidity, ejecting force and the surface condition of the sintered body were obtained. On the other hand, the surface condition of the sintered body of the comparison example was inferior to practical example 3 of the present invention.

PRACTICAL EXAMPLE 4

The identical iron powders, binders, and alloying powders of practical example 1 were used and the added amounts are shown in table 4. In test sample No. 8, the identical copper powder of practical example 1 was used as an alloying powder. In practical example 4, the heating temperature and time were the same as practical example 3. The free powders of stearic acid, oleic acid amide, stearic acid amide, stearic acid bisamide, the heated mixture of stearic acid amide and stearic acid bisamide, and zinc stearate were added as lubricants. These lubricants were added into the above mentioned iron-based powder mixture and mixed for 10 minutes at room temperature. In the comparison example, the identical atomized iron powder of the practical example was used, and the lubricants were added as shown in Table 4. The degree of C adhesion, fluidity, and ejecting force of the obtained mixture were measured in the same manner as practical example 1. The result of the measurement is shown in Table 4. The degree of C adhesion, fluidity, ejecting force, and the surface condition of the sintered body of the practical example 4 of the present invention showed superior characteristics against the comparison examples in which the fluidity and the surface condition of the sintered body, in particular, were inferior due to an excessive amount of the room temperature mixture excepting zinc stearate and the zinc stearate.

TABLE 3

| | | Heating & Melting Mixture (wt %) | | | | | | | | Rt. Powder Mixtr. (wt %) | C Adhesion (%) | Talc Adhesion (%) | Fluidity (sec/100 g) | Ejecting Force (kgf/cm²) | |
|---|---|---|---|---|---|---|---|---|---|---|---|---|---|---|---|
| | | Alloy Powder | | | 1st Group | | | 2nd Group | | | | | | | |
| | No. | Cu | Graphite | *P.I.M. | St. Acid Amd. | Ol. Acid Amd. | St. Acid Amd. | St. Acid BsAmd | | Zn Stearate | | | | | **S.C.S.B. |
| Ex. | 1 | | 0.8 | | 0.2 | | | 0.2 | | 0.2 | 89 | | 12.8 | 106 | ○ |
| | 2 | | 0.8 | | | 0.2 | | 0.2 | | 0.1 | 89 | | 12.6 | 110 | ○ |
| | 3 | 1.5 | 0.8 | | | | 0.2 | 0.2 | | 0.1 | 85 | | 12.5 | 124 | ○ |
| | 4 | | 0.8 | | 0.15 | 0.15 | | 0.1 | | 0.2 | 87 | | 12.7 | 110 | ○ |
| | 5 | | 0.8 | 1.2 | | 0.15 | 0.15 | 0.1 | | 0.1 | 88 | 88 | 12.5 | 111 | ○ |
| | 6 | | 0.8 | | 0.15 | | 0.15 | 0.1 | | 0.1 | 85 | | 12.6 | 114 | ○ |
| | 7 | | 0.8 | | 0.15 | 0.15 | 0.15 | 0.1 | | 0.1 | 89 | | 12.5 | 115 | ○ |
| Comp. Ex. | 1 | | 0.8 | | 0.15 | | 0.15 | 0.1 | | 0.35 | 85 | | 12.6 | 115 | x |

*Powder for Improving Machinability
**Surface Condition of Sintered Body:
○ No Stain on Surface
x Stain on Surface

TABLE 4

| | | Heating & Melting Mixture (wt %) | | | | | | Rt. Powder Mixtr. (wt %) | | | | | | |
|---|---|---|---|---|---|---|---|---|---|---|---|---|---|---|
| | | Alloy Powder | | 1st Group | | | 2nd Group | Exc. Zn Stearate | | | C | Fluid- | Ejecting | |
| | No. | Cu | Graphite | St. Acid | Ol. Acid Amid | St. Acid Amd. | St. Acid BsAmd | Lubricant | Addtv. Amt. | Zn Stearate | Adhe- sion (%) | ity (sec/ 100 g) | Force (kgf/ $cm^2$) | **S.C.S.B. |
| Ex. | 1 | | 0.8 | | | 0.2 | 0.2 | St. Acid | 0.4 | 0.1 | 85 | 12.9 | 95 | ○ |
| | 2 | | 0.8 | 0.15 | | 0.15 | 0.1 | | 0.4 | 0.2 | 85 | 12.8 | 93 | ○ |
| | 3 | | 0.8 | 0.2 | | | 0.2 | Ol. Acid | 0.4 | 0.1 | 89 | 13.0 | 95 | ○ |
| | 4 | | 0.8 | | 0.15 | 0.15 | 0.2 | Amd | 0.5 | 0.1 | 88 | 12.9 | 92 | ○ |
| | 5 | | 0.8 | | 0.2 | | 0.2 | St. Acid | 0.4 | 0.1 | 89 | 12.9 | 97 | ○ |
| | 6 | | 0.8 | 0.15 | 0.15 | | 0.1 | Amd | 0.4 | 0.1 | 87 | 12.9 | 95 | ○ |
| | 7 | | 0.8 | 0.2 | | | 0.2 | St. | 0.3 | 0.1 | 89 | 12.9 | 102 | ○ |
| | 8 | 1.5 | 0.8 | | 0.2 | | 0.2 | Acid | 0.4 | 0.2 | 89 | 12.8 | 99 | ○ |
| | 9 | | 0.8 | | | 0.2 | 0.2 | BsAmd | 0.4 | 0.1 | 85 | 12.7 | 94 | ○ |
| | 10 | | 0.8 | 0.15 | 0.15 | | 0.1 | | 0.4 | 0.1 | 87 | 12.9 | 101 | ○ |
| | 11 | | 0.8 | | 0.15 | 0.15 | 0.1 | | 0.5 | 0.2 | 88 | 12.8 | 93 | ○ |
| | 12 | | 0.8 | 0.15 | | 0.15 | 0.1 | St. Acid | 0.4 | 0.1 | 85 | 12.8 | 92 | ○ |
| | 13 | | 0.8 | 0.15 | 0.15 | 0.15 | 0.1 | BsAmd | 0.4 | 0.1 | 89 | 12.7 | 96 | ○ |
| | 14 | | 0.8 | | | 0.2 | 0.2 | *Mixtr. | 0.5 | 0.1 | 89 | 12.7 | 91 | ○ |
| | 15 | | 0.8 | 0.15 | 0.15 | 0.15 | 0.1 | | 0.4 | 0.2 | 89 | 12.6 | 92 | ○ |
| Comp. | 1 | | 0.8 | 0.2 | | | 0.2 | St. Acid | 0.55 | 0.3 | 89 | 14.6 | 94 | x |
| Ex. | 2 | | 0.8 | | | 0.2 | 0.2 | Ol. Acid Amd | 0.55 | 0.3 | 85 | 15.8 | 114 | x |
| | 3 | | 0.8 | | 0.2 | | 0.2 | St. Acid Amd | 0.55 | 0.3 | 89 | 15.7 | 119 | x |
| | 4 | | 0.8 | 0.2 | | | 0.2 | St. Acid BsAmd | 0.55 | 0.3 | 89 | 15.7 | 111 | x |
| | 5 | | 0.8 | | 0.2 | | 0.2 | *Mixtr. | 0.55 | 0.3 | 89 | 15.5 | 110 | x |

*Heated Mixture of Stearic Acid & Stearic Acid Bisamide
**Surface Condition of Sintered Body:
○ No Stain on Surface
x Stain on Surface According to the present invention, an iron-based powder mixture for powder metallurgy has advantageous characteristics. In comparison with conventional mixtures, the iron-based powder mixture has a stable level of powder metallurgy product and improved machinability due to reduced segregation of the alloying powder and the powder for improving machinability. It has a stabilized filling condition in the die due to superior fluidity of the powder mixture in flowing from the hopper. There is less damage to the molded body, thanks to the reduced force of ejection from the die. There is less and less contamination in the sintering furnace and surface of sintered body because of the use of reduced amounts of metallic elements such as binders and lubricants.

What is claimed is:

1. A method for producing an iron-based powder mixture for powder metallurgy, comprising the steps of:

mixing (A) about 0.1% to about 1.0% by weight of a powder of at least one organic compound selected from the group consisting of stearic acid, oleic acid amide, and stearic acid amide, (B) about 0.1% to about 1.0% by weight of a powder of stearic acid bisamide, (C) about 0.1% to about 3.0% by weight of an alloying powder and/or a powder for improving machinability, and (D) the balance which is an iron-based powder;

mixing and heating the resulting iron-based powder mixture thereafter for about 30 seconds to about 30 minutes at a temperature ranging from about 10° C. above the lowest melting point of the organic compound (A) to the melting point of said stearic acid bisamide (B), and subsequently cooling the mixture.

2. A method for producing an iron-based powder mixture for powder metallurgy, comprising the steps of:

cooling an iron-based powder mixture obtained by the method of claim 1 at a temperature below the melting points of at least some of the ingredients, and mixing thereafter, for about 30 seconds to about 30 minutes, about 0.1% to about 0.5% by weight of at least one free lubricant powder selected from the group consisting of stearic acid, oleic acid amide, stearic acid amide, stearic acid bisamide, and a heated mixture of stearic acid amide and stearic acid bisamide with the iron-based powder mixture as defined in claim 1.

3. A method of producing an iron-based powder mixture for powder metallurgy, comprising the steps of:

cooling an iron-based powder mixture obtained by the method of claim 1 at a temperature below the melting points of at least some of the ingredients, and mixing thereafter, for about 30 seconds to about 30 minutes, about 0.01% to about 0.25% by weight of a free powder of zinc stearate with the iron-based powder mixture as defined in claim 1.

4. A method for producing an iron-based powder mixture for powder metallurgy, comprising the steps of:

cooling an iron-based powder mixture obtained by the method of claim 1 at a temperature below the melting points of at least some of the ingredients, and mixing thereafter, for about 30 seconds to about 30 minutes, about 0.1% to about 0.5% by weight of at least one free lubricant powder selected from the group consisting of stearic acid, oleic acid amide, stearic acid amide, stearic acid bisamide, a heated mixture of stearic acid amide and stearic acid bisamide, and about 0.01% to about 0.25 % by weight of a free powder of zinc stearate, with the iron-based powder mixture as defined in claim 1.

* * * * *